US008771468B2

(12) United States Patent
Shannon et al.

(10) Patent No.: US 8,771,468 B2
(45) **Date of Patent: *Jul. 8, 2014**

(54) TISSUE COMPRISING MACROALGAE

(71) Applicant: Kimberly-Clark Worldwide, Inc., Neenah, WI (US)

(72) Inventors: Thomas Gerard Shannon, Neenah, WI (US); Bo Shi, Neenah, WI (US); Candace Dyan Krautkramer, Neenah, WI (US); Michael William Veith, Fremont, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/043,955

(22) Filed: Oct. 2, 2013

(65) Prior Publication Data

US 2014/0034255 A1 Feb. 6, 2014

Related U.S. Application Data

(62) Division of application No. 13/481,154, filed on May 25, 2012, now Pat. No. 8,574,400.

(51) Int. Cl.
*D21H 11/12* (2006.01)

(52) U.S. Cl.
USPC ..... 162/148; 162/99; 162/129

(58) Field of Classification Search
None
See application file for complete search history.

(56) References Cited

U.S. PATENT DOCUMENTS

| | | | |
|---|---|---|---|
| 1,367,279 | A | 2/1921 | Ignacy |
| 1,509,035 | A | 9/1924 | Curtis et al. |
| 1,675,244 | A | 6/1928 | Frederick |
| 2,965,436 | A | 12/1960 | De Domenico et al. |
| 3,862,877 | A | 1/1975 | Camden |
| 4,300,981 | A | 11/1981 | Carstens |
| 5,114,534 | A | 5/1992 | Rachor et al. |
| 5,200,194 | A | 4/1993 | Edgren et al. |
| 5,472,569 | A | 12/1995 | Nicolucci et al. |
| 5,500,086 | A | 3/1996 | Sakai et al. |
| 5,522,967 | A | 6/1996 | Shet |
| 5,567,275 | A | 10/1996 | Nicolucci et al. |
| 5,743,999 | A | 4/1998 | Kamps et al. |
| 6,379,594 | B1 | 4/2002 | Dopfner et al. |
| 7,622,019 | B2 | 11/2009 | You et al. |
| 2002/0104632 | A1 | 8/2002 | Jimenez et al. |
| 2003/0186611 | A1 | 10/2003 | Zikeli et al. |
| 2006/0137842 | A1 | 6/2006 | Garnier et al. |
| 2007/0207692 | A1 | 9/2007 | Ono et al. |
| 2009/0197994 | A1 | 8/2009 | Han et al. |
| 2010/0137776 | A1 | 6/2010 | Virkus et al. |
| 2010/0152687 | A1 | 6/2010 | Carlozzi |
| 2010/0272940 | A1 | 10/2010 | Shi et al. |
| 2010/0319865 | A1 | 12/2010 | Petersen et al. |
| 2011/0036525 | A1 | 2/2011 | Kim et al. |
| 2011/0303375 | A1 | 12/2011 | Shannon et al. |

FOREIGN PATENT DOCUMENTS

| | | | |
|---|---|---|---|
| CN | 101985779 | A | 3/2011 |
| CN | 102154738 | A | 8/2011 |
| DE | 102004061179 | A1 | 6/2006 |
| DE | 102008053858 | A1 | 5/2010 |
| EP | 0 565 920 | B1 | 10/1995 |
| EP | 1 682 721 | B1 | 5/2009 |
| GB | 508671 | A | 7/1939 |
| JP | 04-202893 | A | 7/1992 |
| JP | 05-331792 | A | 12/1993 |
| JP | 2000-236757 | A | 9/2000 |
| JP | 2011-012036 | A | 1/2011 |
| KR | 2006-0000695 | A | 1/2006 |
| KR | 10-2007-0040555 | A | 4/2007 |
| KR | 10-0811183 | B3 | 3/2008 |
| KR | 10-0811193 | B2 | 3/2008 |
| KR | 10-0811194 | B1 | 3/2008 |
| KR | 10-0811196 | B1 | 3/2008 |
| KR | 10-0811200 | B1 | 3/2008 |
| KR | 10-2010-0011771 | A | 2/2010 |
| KR | 10-0965310 | B1 | 6/2010 |
| KR | 2010-0070240 | A | 6/2010 |
| KR | 2010-0084452 | A | 7/2010 |
| NL | 9001056 | A | 12/1991 |
| TW | 506831 | B | 10/2002 |
| WO | WO 92/02199 | A1 | 2/1992 |
| WO | WO 94/04745 | A1 | 3/1994 |
| WO | WO 96/24317 | A2 | 8/1996 |

OTHER PUBLICATIONS

Seo, Yung Bum et al., "Optical Properties of Red Algae Fibers," Industrial and Engineering Chemistry Research, American Chemical Society, vol. 49, No. 20, Sep. 28, 2010, pp. 9830-9833.

Co-pending U.S. Appl. No. 13/481,125, filed May 25, 2012, by Shi et al. for "High Strength Macroalgae Pulps."

Earthrise® "Natural Spirulina Powder," Material Safety Data Sheet, Earthrise Nutritionals, Calipatria, CA, May 17, 2006, pp. 1-6.

Kim, Byong Hyun and Yung Bum Seo, "Application of Sea Algae Fiber for the Improvement of Compressibility and Physical Properties of Letter Press Printing Paper," Journal of Korea Technical Association of the Pulp and Paper Industry, vol. 4, No. 1, 2008, pp. 15-22.

Seo, Yung-Bum et al., "Red Algae and Their Use in Papermaking," Bioresource Technology, vol. 101, 2010, pp. 2549-2553.

Ververis, C. et al., "Cellulose, Hemicelluloses, Lignin and Ash Content of Some Organic Materials and Their Suitability for Use as Paper Pulp Supplements," Bioresource Technology, vol. 98, 2007, pp. 296-301.

XX International Seaweed Symposium, International Seaweed Association, Ensenada Baja California Mexico, Feb. 22-26, 2010, pp. 1-2, 63, 108.

*Primary Examiner* — Richard Crispino
*Assistant Examiner* — Eric Yaary
(74) *Attorney, Agent, or Firm* — Kimberly-Clark Worldwide, Inc.

(57) ABSTRACT

The disclosure provides tissue webs, and products incorporating the same, where the webs comprise macroalgae fibers. More specifically the disclosure provides soft and durable tissue webs comprising at least about 1 percent macroalgae fiber by weight of the web. In the tissue webs of the present disclosure, macroalgae fibers may preferably replace high average fiber length wood fibers, which increases the strength and durability of the web without negatively stiffness.

19 Claims, No Drawings

TISSUE COMPRISING MACROALGAE

BACKGROUND

Tissue products, such as facial tissues, paper towels, bath tissues, napkins, and other similar products, are designed to include several important properties. For example, the products should have good bulk, a soft feel, and should have good strength and durability. Unfortunately, however, when steps are taken to increase one property of the product, other characteristics of the product are often adversely affected.

To achieve the optimum product properties, tissue products are typically formed, at least in part, from pulps containing wood fibers and often a blend of hardwood and softwood fibers to achieve the desired properties. Typically when attempting to optimize surface softness, as is often the case with tissue products, the papermaker will select the fiber furnish based in part on fiber length, aspect ratio and thickness of the fiber cell wall. Unfortunately, the need for softness is balanced by the need for durability. Durability in tissue products may be defined in terms of tensile strength, burst strength and tear strength. Typically tear strength and burst strength have a positive correlation with tensile strength while tensile strength, and thus durability, and softness are inversely related. Thus the paper maker is continuously challenged with the need to balance the need for softness with a need for durability. Unfortunately, tissue paper durability generally decreases as the average fiber length is reduced. Therefore, simply reducing the pulp average fiber length can result in an undesirable trade-off between product softness and product durability.

Besides durability, long fibers also play an important role in overall tissue product softness. While surface softness in tissue products is an important attribute, a second element in the overall softness of a tissue sheet is stiffness. Stiffness can be measured from the tensile slope of stress-strain tensile curve. Generally, a decrease in tensile slope results in lower stiffness, which typically provides better overall softness. However, at a given tensile strength and slope short fibers will display a greater stiffness than long fibers. While not wishing to be bound by theory, it is believed that this behavior is due to the higher number of hydrogen bonds required to produce a product of a given tensile strength with short fibers than with long fibers. Thus, easily collapsible, low coarseness long fibers, such as those provided by Northern softwood kraft ("NSWK") fibers typically supply the best combination of durability and softness in tissue products when those fibers are used in combination with hardwood kraft fibers, such as Eucalyptus hardwood kraft ("EHWK") fibers. While NSWK fibers have a higher coarseness than EHWK fibers, their small cell wall thickness relative to lumen diameter combined with their long length makes them the ideal candidate for optimizing durability and softness in tissue.

Unfortunately, supply of NSWK is under significant pressure both economically and environmentally. As such, prices of NSWK have escalated significantly creating a need to find alternatives to optimize softness and strength in tissue products. Another type of softwood fiber is Southern softwood kraft ("SSWK"), which is widely used in fluff pulp containing absorbent products such as diapers, feminine care absorbent products and incontinence products. Unfortunately while not under the same supply and environmental pressures as NSWK, SSWK fibers are generally poorly suited for making soft tissue products. While having long fiber length, the SSWK fibers have too wide a cell wall width and too narrow a lumen diameter and thus create stiffer, harsher feeling products than NSWK.

The tissue papermaker who is able to obtain pulps having a desirable combination of fiber length and coarseness from fiber blends generally regarded as inferior with respect to average fiber properties may reap significant cost savings and/or product improvements. For example, the papermaker may wish to make a tissue paper of superior strength without incurring the usual degradation in softness which accompanies higher strength. Alternatively, the papermaker may wish a higher degree of paper surface bonding to reduce the release of free fibers without suffering the usual decrease in softness which accompanies greater bonding of surface fibers. As such, a need currently exists for a tissue product formed from a fiber that will improve durability without negatively affecting other important product properties, such as softness.

Outside of softwood kraft pulp fibers very few options exist for papermakers when seeking a satisfactory fiber to provide strength without negatively impacting softness. Thus, there remains a need for alternative papermaking fibers that may deliver softness while maintaining satisfactory strength.

SUMMARY

It has now been discovered that macroalgae fibers, despite having a relatively short average fiber length and high aspect ratios, may be incorporated into a tissue web, and particularly the non-skin contacting layer of a multi-layered web, to yield webs having improved strength without a significant increase in stiffness. Surprisingly, these properties are particularly acute when macroalgae fibers are substituted for high average fiber length wood fibers, such as softwood fibers and more specifically NSWK.

Accordingly, in certain embodiments, the present disclosure provides a tissue web comprising from about 1 to about 20 percent, by weight, macroalgae fibers.

In other embodiments the present disclosure provides a multi-layered tissue web comprising a first fibrous layer and a second fibrous layer, wherein the first fibrous layer consists essentially of conventional papermaking fibers and the second fibrous layer comprises macroalgae fibers. Preferably the first layer is substantially free of macroalgae fibers and the tissue web comprises from about 1 to about 20 percent, by weight, macroalgae fibers. In a particularly preferred embodiment the first fibrous layer comprises hardwood kraft fibers and the second fibrous layer comprises macroalgae and softwood kraft fibers.

In yet other embodiments the present disclosure provides a tissue web comprising from about 1 to about 20 percent, by weight, macroalgae fibers, the tissue web having a basis weight greater than about 15 gsm, a geometric mean tensile index of at least about 30 and geometric mean slope of less than about 10 kg.

In other embodiments the present disclosure provides a tissue product comprising macroalgae fibers, the tissue product having a plurality of pores with a mean flow pore size less than about 30 microns and wherein no more than five percent of the plurality of pores have a pore size greater than 50 microns, the tissue product having a wet to dry tensile strength ratio in the machine direction of about 0.3 or greater.

In yet other embodiments the present disclosure provides an absorbent article comprising an absorbent core including particulate superabsorbent and tissue product comprising macroalgae fibers, the tissue product having a plurality of pores with a mean flow pore size less than about 30 microns a wet to dry tensile strength ratio in the machine direction of about 0.3 or greater.

In still other embodiments the present disclosure provides a method of forming a macroalgae tissue web comprising the steps of dispersing a dry lap pulp comprising from about 1 to about 30 percent, by weight, microalgae to form a first fiber slurry, dispersing a conventional papermaking pulp to form a second fiber slurry, depositing the first and second fiber slurries onto a forming fabric to form a wet web, dewatering the wet web to a consistency from about 20 to about 30 percent, and drying the wet web to a consistency of greater than about 90 percent thereby forming a macroalgae tissue web.

DEFINITIONS

As used herein the term "macroalgae fibers" refers to any cellulosic fibrous material derived from red algae such as, for example, *Gelidium elegance, Gelidium corneum, Gelidium amansii, Gelidium robustum, Gelidium chilense, Gracelaria verrucosa, Eucheuma Cottonii, Eucheuma Spinosum*, or *Beludul*, or brown algae such as, for example, *Pterocladia capillacea, Pterocladia lucia, Laminaria japonica, Lessonia nigrescens*. Macroalgae fibers generally have an aspect ratio (measured as the average fiber length divided by the average fiber width) of at least about 80.

As used herein the term "red algae fiber" refers to any cellulosic fibrous material derived from Rhodophyta. Particularly preferred red algae fiber include cellulosic fibrous material derived from *Gelidium amansii, Gelidium corneum, Gelidium asperum, Gelidium chilense* and *Gelidium robustum*. Red algae fibers generally have an aspect ratio (measured as the average fiber length divided by the average fiber width) of at least about 80.

As used herein the term "geometric mean modulus" ("GMM") refers to the elastic modulus determined in the dry state and is expressed in units of kilograms of force. The geometric mean modulus is calculated as the square root of the product of the machine direction (MD) and the cross direction (CD) elastic moduli (maximum slopes) of the web.

As used herein the term "geometric mean tensile" ("GMT") refers to the square root of the product of the MD tensile strength and CD tensile strength of the web.

As used herein the term "Machine Direction Durability" generally refers to the ability of the web to resist crack propagation initiated by defects in the web and is calculated from MD Tensile Index (calculated by dividing the MD Tensile Strength by the bone dry basis weight) and MD stretch according to the formula:

$$\text{Machine Direction Durability}=0.6(\text{MD Tensile Index}^{0.74}+\text{MD Stretch}^{0.58})$$

As used herein the term "Stiffness Index" refers to the stiffness of a web at a given tensile strength and is calculated from the geometric mean modulus and the geometric mean tensile strength according to the formula:

$$\text{stiffness Index} = \frac{GMM}{GMT} \times 1,000$$

As used herein the term "average fiber length" refers to the length weighted average length of fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001 percent solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k}(x_i \times n_i)/n$$

where k=maximum fiber length
$x_i$=fiber length
$n_i$=number of fibers having length $x_i$
n=total number of fibers measured.

As used herein the term "basis weight" generally refers to the bone dry weight per unit area of a tissue. Basis weight is measured herein using TAPPI test method T-220.

As used herein the term "tissue product" generally refers to various paper products, such as facial tissue, bath tissue, paper towels, napkins, and the like. Normally, the basis weight of a tissue product of the present invention is less than about 80 grams per square meter (gsm), in some embodiments less than about 60 gsm, and in some embodiments, between about 10 to about 60 gsm.

Tissue products are further differentiated from other paper products in terms of their bulk. The bulk of the tissue and towel products of the present invention is calculated as the quotient of the caliper expressed in microns, divided by the basis weight, expressed in grams per square meter. The resulting bulk is expressed as cubic centimeters per gram. In certain embodiments tissue products may have a bulk greater than about 5 $cm^3/g$ and still more preferably greater than about 7 $cm^3/g$, such as from about 7 to about 15 $cm^3/g$. Tissue webs prepared according to the present disclosure may have higher bulk than the tissue products incorporating the same webs. For example, tissue webs may have a bulk greater than about 7 $cm^3/g$, such as greater than about 10 $cm^3/g$, such as from about 12 to about 24 $cm^3/g$.

As used herein, the term "layer" refers to a plurality of strata of fibers, chemical treatments, or the like, within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

DETAILED DESCRIPTION

In general, the present disclosure relates to tissue webs, and products produced therefrom, comprising conventional papermaking fibers and macroalgae fibers. It has been discovered that by replacing some of the conventional papermaking fibers in the tissue web with macroalgae fibers that a stronger and more durable web may be produced without sacrificing softness.

The discovery that macroalgae fibers may be used to form soft, strong tissue webs and more specifically that macroalgae fibers may be used as a replacement for long average length fibers, is particularly surprising provided the relative short length of macroalgae fibers and their high aspect ratio. Table 1 compares the fiber properties of three different fibers—hardwood, softwood and macroalgae.

TABLE 1

| Fiber Type | Average Fiber Length (mm) | Average Fiber Width (μm) | Fiber Length: Fiber Width |
|---|---|---|---|
| *G. amansii* | 0.7 | 5 | 140 |
| NSWK Pulp Fiber | 2.18 | 27.6 | 79 |
| Eucalyptus Pulp Fiber | 0.76 | 19.1 | 40 |

For macroalgae pulp fibers, the ratio of length to width (commonly referred to as the "aspect ratio") generally varies between about 120 and about 250, although both length and width vary amongst species. Generally average fiber lengths for macroalgae fibers range from about 0.3 to about 1.0 mm, while fiber width varies from about 3 to about 7 μm. As shown in Table 1, macroalgae fibers are generally shorter than both EHWK and NSWK fibers, but have significantly greater aspect ratios.

Despite the tendency of macroalgae fibers to have high aspect ratios and short average fiber lengths it has now been surprisingly discovered that they may be a satisfactory replacement for conventional papermaking fibers in tissue webs. In particular, it has been surprisingly discovered that macroalgae fibers may be used as a replacement for conventional papermaking fibers while actually increasing tensile strength without negatively effecting stiffness. In fact, in certain instances, the increase in tensile may be accompanied by only a slight increase in geometric mean modulus, resulting in a web having a lower stiffness index. The effect on tensile and stiffness is particularly acute when the macroalgae is substituted for longer fibers, such as softwood kraft fibers, and when the macroalgae is disposed in the center layer of a multi-layered web. For example, tables 2 and 3 compare three different multi-layered webs prepared using conventional wet pressing.

TABLE 2

| | Macroalgae (% total sheet weight) | Basis Wt. (gsm) | GMT (g/3") | GMT Index | GMM (kg) | Stiffness Index | MD Durability Index |
|---|---|---|---|---|---|---|---|
| Control | 0 | 15.7 | 417 | 26.6 | 4.75 | 11.39 | 12.43 |
| Outer Layer | 1.8 | 16.0 | 484 | 30.2 | 5.37 | 11.09 | 12.84 |
| Inner Layer | 1.8 | 15.3 | 571 | 37.3 | 5.16 | 9.04 | 14.17 |

TABLE 3

| | Delta GMT Index | Delta Stiffness Index | Delta MD Durability Index |
|---|---|---|---|
| Outer Layer | 3.65 | −0.30 | 0.41 |
| Inner Layer | 10.72 | −2.35 | 1.74 |

The macroalgae fibers are preferably derived from algae from the Division Rhodophyta. More preferably the macroalgae fibers have been subjected to processing to remove hydrocolloids, and more preferably agar, from the cell wall. For example, macroalgae fibers may be processed by extracting heteropolysaccharides as a cell wall component with hot water, followed by freezing, melting and drying. More preferably the macroalgae fibers are prepared using pulping methods known in the art such as those disclosed in U.S. Pat. No. 7,622,019, the contents of which are incorporated herein in a manner consistent with the present disclosure. Regardless of the specific method of extraction, in certain embodiments it may be desirable that the macroalgae fibers have been processed such that the resulting fibers have an agar content of less than about 5 percent by weight of the fibers, more preferably less than about 3 percent by weight of the fibers and still more preferably less than about 2 percent by weight of the fibers.

In certain embodiments the pulped macroalgae fibers may be subjected to bleaching. For example, pulped macroalgae fibers may be subjected to a two stage bleaching treatment using a chlorine dioxide in the first stage and hydrogen peroxide in the second stage. In the first stage 5 percent active chlorine dioxide by dry weight of the material may be used to bleach the fiber at pH 3.5 and 80° C. for about 60 minutes. In the second stage, 5 percent active hydrogen peroxide by dry weight of the material may be used to bleach the fiber at pH 12 and 80° C. for about 60 minutes.

The macroalgae fibers preferably have an average fiber length greater than about 300 μm, such as from about 300 to about 1000 μm and more preferably from about 300 to about 700 μm. The macroalgae fibers preferably have a width greater than about 3 μm, such as from about 3 to about 10 μm, and more preferably from about 5 to about 7 μm. Accordingly, it is preferred that the macroalgae fibers have an aspect ratio greater than about 80, such as from about 100 to about 400 and more preferably from about 150 to about 350.

The macroalgae pulp fibers may be used as either dry or wet lap pulps. In those embodiments where the macroalgae is used as a dry lap (a pulp having a moisture content less than about 50 percent, more preferably from about 1 to about 15 percent) it is preferred that it is coprocessed with conventional papermaking fibers and more preferably that the pulped macroalgae fibers are not dried prior to processing with conventional papermaking fibers.

In particularly preferred embodiments macroalgae fibers are provided as dry lap pulps, a fibrous web having a basis weight of at least about 150 grams per square meter (gsm) and a moisture content of less than about 30 percent and more preferably less than about 20 percent, such as from about 1 to about 10 percent moisture. The macroalgae pulps are preferably provided as a blend of macroalgae pulp fiber and conventional papermaking fibers, such that the pulp comprises less than about 30 percent macroalgae fibers by weight. The dry lap pulps may be manufactured by blending never-dried macroalgae fibers with conventional papermaking fibers, forming a wet fiber web from the blended fibers and then drying the fiber web to form dry pulp sheets. The resulting pulp sheets surprisingly have improved strength and durability compared to both pulp sheets formed from dried macroalgae fibers and pulp sheets formed from conventional papermaking fibers alone. Further, pulps prepared as described herein are readily dispersible using traditional processing equipment, such as hydropulpers.

Regardless of the species or particular average fiber length, tissue webs of the present disclosure comprise at least about 1 percent macroalgae, by total weight of the web, and more preferably at least about 2 percent and still more preferably from about 3 to about 20 percent. The tissue webs comprising macroalgae may be either blended or layered webs. Where the webs are multi-layered web they may be layered such that one layer is substantially free from macroalgae fibers, while another layer comprises conventional papermaking and macroalgae fibers. It should be understood that, when referring to a layer that is substantially free of macroalgae fibers, negligible amounts of the fibers may be present therein, however, such small amounts often arise from the macroalgae fibers applied to an adjacent layer, and do not typically substantially affect the softness or other physical characteristics of the web.

Conventional papermaking fibers may comprise wood pulp fibers formed by a variety of pulping processes, such as kraft pulp, sulfite pulp, thermomechanical pulp, and the like. Further, the wood fibers may be any high-average fiber length wood pulp, low-average fiber length wood pulp, or mixtures of the same. One example of suitable high-average length wood pulp fibers include softwood fibers such as, but not limited to, northern softwood, southern softwood, redwood, red cedar, hemlock, pine (e.g., southern pines), spruce (e.g., black spruce), combinations thereof, and the like. One example of suitable low-average length wood pulp fibers include hardwood fibers, such as, but not limited to, eucalyptus, maple, birch, aspen, and the like. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste.

In a particularly preferred embodiment macroalgae fibers are utilized in the tissue web as a replacement for high average fiber length wood fibers such as softwood fibers and more specifically Northern softwood kraft fibers. In one particular embodiment, macroalgae fibers are incorporated into a multi-layered web having two outer layers comprising hardwood fibers and an inner layer comprising softwood fiber, where the macroalgae is incorporated into the inner layer displacing a portion of the softwood fiber. In such embodiments the macroalgae fiber may be added to the middle layer such that the middle layer comprises greater than about 2 percent, by weight of the layer, macroalgae fiber, such as from about 2 to about 40 percent and more preferably from about 5 to about 30 percent.

In addition to varying the amount of macroalgae within the web, as well as the amount in any given layer, the physical properties of the web may be varied by specifically selecting particular layer(s) for incorporation of the macroalgae fibers. It has now been discovered that the greatest increase in tensile is achieved by selectively incorporating the macroalgae fibers in a multi-layered web such that the layer comprising macroalgae is not brought into contact with the user's skin in-use. Further, if desired, the surface properties of the web, such as surface smoothness (measured as coefficient of friction) and web pore size may be modified by selectively incorporating the macroalgae fibers in a multi-layered web such that the layer comprising macroalgae is the layer that is brought into contact with the user's skin in-use.

In a particularly preferred embodiment, the present disclosure provides a tissue web having enhanced tensile strength without a corresponding increase in stiffness, where the web comprises a first and a second fibrous layer, wherein the first fibrous layer comprises hardwood kraft fibers and the second fibrous layer comprises softwood kraft fibers and macroalgae fibers, wherein the amount of macroalgae fibers is from about 2 to about 40 percent by weight of the second layer. Preferably multi-layered webs having macroalgae selectively incorporated into the second fibrous layer have basis weights of at least about 15 gsm and geometric mean tensile strengths greater than about 300 g/3", such as from about 300 to about 1500 g/3". The tensile strengths are preferably achieved without making the web overly stiff, as such the webs preferably have a Stiffness Index of less than about 12 and more preferably less than about 10, such as from about 8 to about 10.

While the web properties, such as tensile, stiffness and durability may be varied by selectively incorporating macroalgae into a particular layer of a multi-layered web, the benefits of using macroalgae may also be achieved by blending macroalgae and wood fibers to form a blended tissue web. In particular, macroalgae may be blended with wood fibers to increase the strength of the web while reducing the average pore size, compared to webs made from wood fibers alone. Such blended tissue webs preferably have a mean flow pore size less than about 30 microns, such as from about 5 to about 20 microns and a geometric mean tensile strength greater than about 300 g/3" and more preferably greater than about 5000 g/3", such as from about 500 to about 1500 g/3".

In other embodiments the present disclosure provides a tissue web comprising macroalgae that may be useful as wrapping material for wrapping an absorbent core. The tissue-wrapped absorbent core made from a blend of macroalgae and conventional papermaking fibers may be useful in personal care absorbent products such as diapers, training pants, incontinence garments, sanitary napkins, bandages, and the like. To aid in the retention of absorbent material it is preferred that the core wrap have a plurality of pores with a mean flow pore size less than about 30 microns and wherein no more than 5 percent of the plurality of pores have a pore size greater than 50 microns. The core wrap is used to envelope an absorbent core including particulate superabsorbent. Due to the nature of the construction of the core wrap, the core wrap preferably has a Shake Out of less about 10 mg, more preferably less than 6 mg and still more preferably less than about 4 mg of particulate superabsorbent.

It is further desirable that the core wrap have a wet to dry strength ratio greater than about 0.3, such as from about 0.3 to about 0.5. A common problem with paper tissue wrap is that it has inadequate strength in the wet state. Typically a paper tissue wrap will have a wet to dry strength ratio in either the machine direction (MD) or cross-machine direction (CD) as measured by the test method outlined below of less than about 0.3. In contrast, the core wrap of the present disclosure generally has a dry strength ratio greater than about 0.3, such as from about 0.3 to about 0.5.

The tissue webs may also be incorporated into tissue products that may be either single- or multi-ply, where one or more of the plies may be formed by a multi-layered tissue web having macroalgae fibers selectively incorporated in one of its layers. In one embodiment the tissue product is constructed such that the macroalgae fibers are not brought into contact with the user's skin in-use. For example, the tissue product may comprise two multi-layered through-air dried webs wherein each web comprises a first fibrous layer substantially free from macroalgae and a second fibrous layer comprising macroalgae. The webs are plied together such that the outer surface of the tissue product is formed from the first fibrous layers of each web, such that the surface brought into contact with the user's skin in-use is substantially free of macroalgae fibers.

In other embodiments the present disclosure provides a two-ply tissue product comprising an upper multi-layered tissue web and a lower multi-layered tissue web that are plied together using well-known techniques. The multi-layered webs comprise at least a first and a second layer, wherein macroalgae fibers are selectively incorporated in only one of the layers, such that when the webs are plied together the layers containing the macroalgae fibers are not brought into contact with the user's skin in-use. For example, the two-ply tissue product may comprise a first and second tissue web, wherein the tissue webs each comprise a first and second layer. The first layer of each tissue web comprises wood fibers and is substantially free of macroalgae fibers, while the second layer of each tissue web comprises macroalgae fibers. When the tissue webs are plied together to form the tissue product the second layers of each web are arranged in a facing relationship such that the macroalgae fibers are not brought into contact with the user's skin in-use.

If desired, various chemical compositions may be applied to one or more layers of the multi-layered tissue web to further enhance softness and/or reduce the generation of lint or slough. For example, in some embodiments, a wet strength agent can be utilized, to further increase the strength of the tissue product when wet. As used herein, a "wet strength agent" is any material that, when added to pulp fibers can provide a resulting web or sheet with a wet geometric tensile strength to dry geometric tensile strength ratio in excess of about 0.1. Typically these materials are termed either "permanent" wet strength agents or "temporary" wet strength agents. As is well known in the art, temporary and permanent wet strength agents may also sometimes function as dry strength agents to enhance the strength of the tissue product when dry.

Wet strength agents may be applied in various amounts depending on the desired characteristics of the web. For instance, in some embodiments, the total amount of wet strength agents added can be between about 1 to about 60 pounds per ton (lbs/T), in some embodiments, between about 5 to about 30 lbs/T, and in some embodiments, between about 7 to about 13 lbs/T of the dry weight of fibrous material. The wet strength agents can be incorporated into any layer of the multi-layered tissue web.

A chemical debonder can also be applied to soften the web. Specifically, a chemical debonder can reduce the amount of hydrogen bonds within one or more layers of the web, which results in a softer product. Depending on the desired characteristics of the resulting tissue product, the debonder can be utilized in varying amounts. For example, in some embodiments, the debonder can be applied in an amount between about 1 to about 30 lbs/T, in some embodiments between about 3 to about 20 lbs/T, and in some embodiments, between about 6 to about 15 lbs/T of the dry weight of fibrous material. The debonder can be incorporated into any layer of the multi-layered tissue web.

Any material capable of enhancing the soft feel of a web by disrupting hydrogen bonding can generally be used as a debonder in the present invention. In particular, as stated above, it is typically desired that the debonder possess a cationic charge for forming an electrostatic bond with anionic groups present on the pulp. Some examples of suitable cationic debonders can include, but are not limited to, quaternary ammonium compounds, imidazolinium compounds, bis-imidazolinium compounds, diquaternary ammonium compounds, polyquaternary ammonium compounds, ester-functional quaternary ammonium compounds (e.g., quaternized fatty acid trialkanolamine ester salts), phospholipid derivatives, polydimethylsiloxanes and related cationic and non-ionic silicone compounds, fatty and carboxylic acid derivatives, mono and polysaccharide derivatives, polyhydroxy hydrocarbons, etc. For instance, some suitable debonders are described in U.S. Pat. Nos. 5,716,498, 5,730,839, 6,211,139, 5,543,067, and WO/0021918, all of which are incorporated herein in a manner consistent with the present disclosure.

Still other suitable debonders are disclosed in U.S. Pat. Nos. 5,529,665 and 5,558,873, both of which are incorporated herein in a manner consistent with the present disclosure. In particular, U.S. Pat. No. 5,529,665 discloses the use of various cationic silicone compositions as softening agents.

Tissue webs of the present disclosure can generally be formed by any of a variety of papermaking processes known in the art. Preferably the tissue web is formed by through-air drying and be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present disclosure. When forming multi-ply tissue products, the separate plies can be made from the same process or from different processes as desired.

For example, in one embodiment, tissue webs may be creped through-air dried webs formed using processes known in the art. To form such webs, an endless traveling forming fabric, suitably supported and driven by rolls, receives the layered papermaking stock issuing from headbox. A vacuum box is disposed beneath the forming fabric and is adapted to remove water from the fiber furnish to assist in forming a web. From the forming fabric, a formed web is transferred to a second fabric, which may be either a wire or a felt. The fabric is supported for movement around a continuous path by a plurality of guide rolls. A pick up roll designed to facilitate transfer of web from fabric to fabric may be included to transfer the web.

Preferably the formed web is dried by transfer to the surface of a rotatable heated dryer drum, such as a Yankee dryer. The web may be transferred to the Yankee directly from the throughdrying fabric or, preferably, transferred to an impression fabric which is then used to transfer the web to the Yankee dryer. In accordance with the present disclosure, the creping composition of the present disclosure may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from the dryer drum by a creping blade. The creping web as it is formed further reduces internal bonding within the web and increases softness. Applying the creping composition to the web during creping, on the other hand, may increase the strength of the web.

In another embodiment the formed web is transferred to the surface of the rotatable heated dryer drum, which may be a Yankee dryer. The press roll may, in one embodiment, comprise a suction pressure roll. In order to adhere the web to the surface of the dryer drum, a creping adhesive may be applied to the surface of the dryer drum by a spraying device. The spraying device may emit a creping composition made in accordance with the present disclosure or may emit a conventional creping adhesive. The web is adhered to the surface of the dryer drum and then creped from the drum using the creping blade. If desired, the dryer drum may be associated with a hood. The hood may be used to force air against or through the web.

In other embodiments, once creped from the dryer drum, the web may be adhered to a second dryer drum. The second dryer drum may comprise, for instance, a heated drum surrounded by a hood. The drum may be heated from about 25 to about 200° C., such as from about 100 to about 150° C.

In order to adhere the web to the second dryer drum, a second spray device may emit an adhesive onto the surface of the dryer drum. In accordance with the present disclosure, for instance, the second spray device may emit a creping composition as described above. The creping composition not only assists in adhering the tissue web to the dryer drum, but also is transferred to the surface of the web as the web is creped from the dryer drum by the creping blade.

Once creped from the second dryer drum, the web may, optionally, be fed around a cooling reel drum and cooled prior to being wound on a reel.

For example, once a fibrous web is formed and dried, in one aspect, the creping composition may be applied to at least one side of the web and the at least one side of the web may then be creped. In general, the creping composition may be applied to only one side of the web and only one side of the web may be creped, the creping composition may be applied to both sides of the web and only one side of the web is creped, or the creping composition may be applied to each side of the web and each side of the web may be creped.

Once creped the tissue web may be pulled through a drying station. The drying station can include any form of a heating unit, such as an oven energized by infra-red heat, microwave energy, hot air, or the like. A drying station may be necessary in some applications to dry the web and/or cure the creping composition. Depending upon the creping composition selected, however, in other applications a drying station may not be needed.

In other embodiments, the base web is formed by an uncreped through-air drying process such as those described, for example, in U.S. Pat. Nos. 5,656,132 and 6,017,417, both of which are hereby incorporated by reference herein in a manner consistent with the present disclosure. The uncreped through-air drying process may comprise a twin wire former having a papermaking headbox which injects or deposits a furnish of an aqueous suspension of wood fibers onto a plurality of forming fabrics, such as an outer forming fabric and an inner forming fabric, thereby forming a wet tissue web. The forming process may be any conventional forming process known in the papermaking industry. Such formation processes include, but are not limited to, Fourdriniers, roof formers such as suction breast roll formers, and gap formers such as twin wire formers and crescent formers.

The wet tissue web forms on the inner forming fabric as the inner forming fabric revolves about a forming roll. The inner forming fabric serves to support and carry the newly-formed wet tissue web downstream in the process as the wet tissue web is partially dewatered to a consistency of about 10 percent based on the dry weight of the fibers. Additional dewatering of the wet tissue web may be carried out by known paper making techniques, such as vacuum suction boxes, while the inner forming fabric supports the wet tissue web. The wet tissue web may be additionally dewatered to a consistency of at least about 20 percent, more specifically between about 20 to about 40 percent, and more specifically about 20 to about 30 percent.

The forming fabric can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.). The wet web is then transferred from the forming fabric to a transfer fabric while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric may be carried out with the assistance of positive and/or negative pressure. For example, in one embodiment, a vacuum shoe can apply negative pressure such that the forming fabric and the transfer fabric simultaneously converge and diverge at the leading edge of the vacuum slot. Typically, the vacuum shoe supplies pressure at levels between about 10 to about 25 inches of mercury. As stated above, the vacuum transfer shoe (negative pressure) can be supplemented or replaced by the use of positive pressure from the opposite side of the web to blow the web onto the next fabric. In some embodiments, other vacuum shoes can also be used to assist in drawing the fibrous web onto the surface of the transfer fabric.

Typically, the transfer fabric travels at a slower speed than the forming fabric to enhance the MD and CD stretch of the web, which generally refers to the stretch of a web in its cross (CD) or machine direction (MD) (expressed as percent elongation at sample failure). For example, the relative speed difference between the two fabrics can be from about 1 to about 30 percent, in some embodiments from about 5 to about 20 percent, and in some embodiments, from about 10 to about 15 percent. This is commonly referred to as "rush transfer." During "rush transfer," many of the bonds of the web are believed to be broken, thereby forcing the sheet to bend and fold into the depressions on the surface of the transfer fabric 8. Such molding to the contours of the surface of the transfer fabric 8 may increase the MD and CD stretch of the web. Rush transfer from one fabric to another can follow the principles taught in any one of the following, U.S. Pat. Nos. 5,667,636, 5,830,321, 4,440,597, 4,551,199, 4,849,054, all of which are hereby incorporated by reference herein in a manner consistent with the present disclosure. The wet tissue web is then transferred from the transfer fabric to a throughdrying fabric.

While supported by the throughdrying fabric, the wet tissue web is dried to a final consistency of about 94 percent or greater by a throughdryer. The drying process can be any noncompressive drying method which tends to preserve the bulk or thickness of the wet web including, without limitation, throughdrying, infra-red radiation, microwave drying, etc. Because of its commercial availability and practicality, throughdrying is well known and is one commonly used means for noncompressively drying the web for purposes of this invention. Suitable throughdrying fabrics include, without limitation, fabrics with substantially continuous machine direction ridges whereby the ridges are made up of multiple warp strands grouped together, such as those disclosed in U.S. Pat. No. 6,998,024. Other suitable throughdrying fabrics include those disclosed in U.S. Pat. No. 7,611,607, which is incorporated herein in a manner consistent with the present disclosure, particularly the fabrics denoted as Fred (t1207-77), Jeston (t1207-6) and Jack (t1207-12). The web is preferably dried to final dryness on the throughdrying fabric, without being pressed against the surface of a Yankee dryer, and without subsequent creping.

Additionally, webs prepared according to the present disclosure may be subjected to any suitable post processing including, but not limited to, printing, embossing, calendering, slitting, folding, combining with other fibrous structures, and the like.

Test Methods

Sheet Bulk

Sheet Bulk is calculated as the quotient of the dry sheet caliper expressed in microns, divided by the dry basis weight, expressed in grams per square meter. The resulting Sheet Bulk is expressed in cubic centimeters per gram. More specifically, the Sheet Bulk is the representative thickness of a single tissue sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board." The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Tear

Tear testing was carried out in accordance with TAPPI test method T-414 "Internal Tearing Resistance of Paper (Elmendorf-type method)" using a falling pendulum instrument such as Lorentzen & Wettre Model SE 009. Tear strength is directional and MD and CD tear are measured independently.

More particularly, a rectangular test specimen of the sample to be tested is cut out of the tissue product or tissue basesheet such that the test specimen measures 63 mm±0.15 mm (2.5 inches±0.006 inch) in the direction to be tested (such as the MD or CD direction) and between 73 and 114 millimeters (2.9 and 4.6 inches) in the other direction. The specimen edges must be cut parallel and perpendicular to the testing direction (not skewed). Any suitable cutting device, capable of the proscribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For basesheets intended to be multiple ply products, the tear results are reported as the tear of the multiple ply product and not the single ply basesheet. This is done by multiplying the single ply basesheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3 inches±0.05 inch (76.2 mm±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

Burst Strength

Burst strength herein is a measure of the ability of a fibrous structure to absorb energy, when subjected to deformation normal to the plane of the fibrous structure. Burst strength may be measured in general accordance with ASTM D-6548 with the exception that the testing is done on a Constant-Rate-of-Extension (MTS Systems Corporation, Eden Prairie, Minn.) tensile tester with a computer-based data acquisition and frame control system, where the load cell is positioned above the specimen clamp such that the penetration member is lowered into the test specimen causing it to rupture. The arrangement of the load cell and the specimen is opposite that illustrated in FIG. 1 of ASTM D-6548. The penetration assembly consists of a semi spherical anodized aluminum penetration member having a diameter of 1.588±0.005 cm affixed to an adjustable rod having a ball end socket. The test specimen is secured in a specimen clamp consisting of upper and lower concentric rings of aluminum between which the sample is held firmly by mechanical clamping during testing. The specimen clamping rings has an internal diameter of 8.89±0.03 cm.

The tensile tester is set up such that the crosshead speed is 15.2 cm/min, the probe separation is 104 mm, the break sensitivity is 60 percent and the slack compensation is 10 gf and the instrument is calibrated according to the manufacturer's instructions.

Samples are conditioned under TAPPI conditions and cut into 127×127 mm±5 mm squares. For each test a total of 3 sheets of product are combined. The sheets are stacked on top of one another in a manner such that the machine direction of the sheets is aligned. Where samples comprise multiple plies, the plies are not separated for testing. In each instance the test sample comprises 3 sheets of product. For example, if the product is a 2-ply tissue product, 3 sheets of product totaling 6 plies are tested. If the product is a single ply tissue product, then 3 sheets of product totaling 3 plies are tested.

Prior to testing the height of the probe is adjusted as necessary by inserting the burst fixture into the bottom of the tensile tester and lowering the probe until it was positioned approximately 12.7 mm above the alignment plate. The length of the probe is then adjusted until it rests in the recessed area of the alignment plate when lowered.

It is recommended to use a load cell in which the majority of the peak load results fall between 10 and 90% of the capacity of the load cell. To determine the most appropriate load cell for testing, samples are initially tested to determine peak load. If peak load is <450 gf a 10 Newton load cell is used, if peak load is >450 gf a 50 Newton load cell is used.

Once the apparatus is set-up and a load cell selected, samples are tested by inserting the sample into the specimen clamp and clamping the test sample in place. The test sequence is then activated, causing the penetration assembly to be lowered at the rate and distance specified above. Upon rupture of the test specimen by the penetration assembly the measured resistance to penetration force is displayed and recorded. The specimen clamp is then released to remove the sample and ready the apparatus for the next test.

The peak load (gf) and energy to peak (g-cm) are recorded and the process repeated for all remaining specimens. A minimum of five specimens are tested per sample and the peak load average of five tests is reported as the Dry Burst Strength.

Retention Capacity

The following test is used to determine a saturation capacity of an absorbent material. A tissue sample having length and width dimensions of approximately four inches by four inches (approximately 10.16 cm by 10.16 cm) is weighed and the weight in grams is recorded. The sample is then submerged in an excess quantity of 0.9 weight percent sodium chloride solution in distilled water at room temperature (e.g., about 23° C.) for about five minutes. After this time period, the sample is removed from the test solution and placed on a test apparatus (apparatus is illustrated in U.S. application Ser. No. 11/153,190, the contents of which are hereby incorporated by reference in a manner consistent with the present disclosure) comprising a vacuum box, a TEFLON fiberglass screen having 0.25 inch (0.6 cm) openings and supported by the vacuum box, and a flexible rubber cover sized for overlaying the screen on the vacuum box.

More particularly, the sample is placed uncovered (by the rubber cover) on the screen and allowed to drip dry for about one minute. The rubber cover is then placed over the sample and screen (e.g., to generally form a seal over the vacuum box) and a vacuum (V) of about 0.5 pounds/square inch is drawn on the vacuum box (and hence the sample) for a period of about three minutes. The sample is then removed and weighed again. The retention capacity of the sample is determined by subtracting the dry weight of the sample from the weight of the recovered sample after application of the vacuum and then dividing by the dry weight of the sample and is recorded as grams of liquid retained per gram of absorbent structure (g/g).

If absorbent material fibers are drawn through the fiberglass screen into the vacuum box during testing, a screen having smaller openings should be used and the test should be re-done. At least three samples are tested and the results are averaged to provide the retention capacity (e.g., total and normalized retention capacity) of the sample.

Wicking Capacity

The Wicking Capacity determines the amount of test solution (0.9 weight percent solution of sodium chloride in distilled water) that will wick upward into an absorbent structure during a 30 minute period. The test is performed substantially as described in U.S. Pat. No. 6,465,712, which is incorporated herein by reference in a manner consistent with the present specification.

A sample of the absorbent material to be tested is prepared to have dimensions of about 3 inches wide by about 7 inches long, e.g., either formed or otherwise cut from a larger absorbent structure. The sample is then clamped to one face of an acrylic board measuring 25 cm high by 15 cm wide by 0.5 cm thick such that one end of the sample extends slightly beyond the bottom end of the acrylic board. The sample is further held in place on the board by two clamps extended around the side edges of the board so as to grasp the side edges of the sample near the top of the sample. The side of the board may be scaled in 1 mm increments to measure the vertical height of the wicked solution.

The sample (and board) is then hung from a strain gauge and the sample is lowered into a self-leveling reservoir of the test solution of 0.9 weight percent sodium chloride solution in distilled water until the lower end of the sample contacts the solution. A timer with one second increments is started just as the sample contacts the liquid. The solution is allowed to be taken into the sample and wick upward therein for a period of about thirty minutes. Mass of saline wicking into the sample is recorded over some length of time. The sample is then removed from the reservoir and taken off of the board and weighed.

The wet sample is then placed in an X-ray unit for X-ray imaging test. Suitable X-ray units are commercially available from Tronix Inc., Branford, Conn., such as model no. 10561 HF 100. The X-ray system was operated with an exposure time of 2 seconds, with a tube voltage of 50 Kv and current of 12 mA. The resulting X-ray image is used to determine the amount of fluid of specific areas. Fluid amount at 10 cm is the fluid held in the sample at and below 10 cm of height. Image analysis may be carried out using software commercially available from Optumus Inc., Ft. Collins, Colo., such as BIOSCAN OPTIMATE S/N OPM4101105461 version 4.11.

Coulter Porometer Mean Flow Pore Size and Pore Size Distribution Test

A Coulter 115/60 porometer from Coulter Electronics, Ltd. of Luton, England, was used to determine mean flow pore size, maximum flow pore size and pore size distribution. The apparatus was capable of measuring pore sizes up to 300 microns. Determinations of the mean flow pore size, maximum flow pore size and pore size distribution were made in accordance with ASTM Standard Test Methods Designation F316-06 for Pore Size Characteristics of Membrane Filters by Bubble Point And Mean Flow Pore Test.

Shake Out Test

The susceptibility of a material to the migration and escape of superabsorbent material (SAM) can be measured by employing a Shakeout Test procedure which involves agitating web samples in a controlled fashion and determining the total loss of SAM through the sample. Determination of the shake-out value of a sample material was performed in accordance with the Shake Out Test Method described. A test sample should be cut and placed between the top and bottom sieve. After placing over a collection pan, it should be placed in a Ro-Tap Mechanical Sieve Shaker available from W. S. Tyler Inc. A pre-weighed SAM amount should be poured into the top sieve and covered. Run the Ro-Tap instrument for 10 minutes.

After the completion of the shaking portion of the test, the superabsorbent loss from the sieve is determined by comparing the total remaining mass of the test sample and SAM with the original mass of the sample when the sample was initially placed on the support screen, in accordance with the following formula: Mass loss (%)=100%×((M$_0$−M$_{end}$)+M$_0$) where: M$_0$=sample mass prior to shakeout test (e.g., grams); M$_{end}$=sample mass remaining after test (e.g., grams). The shake-out value (%) is the total mass loss (%) produced at the above-described shaking conditions.

EXAMPLES

Commodity pulps were obtained as follows—Eucalyptus kraft pulp ("EHWK") was obtained from Fibria, San Paulo, Brazil, Southern softwood kraft pulp ("SSWK") was obtained from Abitibi Bowater, Mobile, Ala., North softwood kraft pulp ("NSWK") was obtained from Northern Pulp Nova Scotia Corporation, Abercrombie, NS, and wet (never-dried) red algae pulp was obtained from Pegasus International, Daejeon, Korea.

Dry lap red algae pulp was prepared by blending EHWK or SSWK with wet red algae pulp and forming a dry lap pulp sheet using a Fourdrinier machine comprising a wire forming section, a suction box, a pair of registered wet press rolls, and three cylindrical air dryers. Each fiber type was weighed individually and dispersed in a pulper for 25 to 30 minutes, yielding a fiber slurry with a consistency of 3 percent, and then returned to a stock tank for use in the formation of the pulp sheet. The entire stock preparation system was heated to 50° C.

The fiber slurries were mixed depending on the desired blend of the dry lap pulp and then pumped to the headbox and deposited onto the forming section of the paper machine under pressure to increase drainage. The resulting fibrous web was pressed to further remove water using weight of the first press roll, which was adjusted to maximize caliper. The dewatered fibrous web was subjected to drying using a series of dryer cans, the initial dryer can pressures was 100 pounds per square inch (psig) in the first, second, and third section, corresponding to about 177° C. The resulting dry lap pulp sheet had a moisture content of less than about 10 percent and a basis weight of about 230 gsm. Three different blends of dry lab red algae pulps were prepared—80% EHWK/20% red algae, 90% EHWK/10% red algae, or 80% SSWK/20% (all % expressed as weight % of bone dry lap pulp sheet).

Example 1

Conventional Wet Pressed Tissue Comprising Macroalgae Dry Lap Pulp

Sample tissue webs were made using a wet pressed process utilizing a Crescent Former according to the following process. Initially NSWK was dispersed in a pulper for 30 minutes at 3 percent consistency at about 100° F. The NSWK was then transferred to a dump chest and subsequently diluted to approximately 0.75 percent consistency. EHWK was dispersed in a pulper for 30 minutes at about 3 percent consistency at about 100° F. The EHWK was then transferred to a dump chest and subsequently diluted to about 0.75 percent consistency. Dry lap red algae pulp (80% EHWK/20% red algae by weight), prepared as described above, was dispersed in a pulper for 30 minutes at about 3 percent consistency at about 100° F. and then transferred to a dump chest and subsequently diluted to about 0.75 percent consistency.

The pulp slurries were subsequently pumped to separate machine chests and further diluted to a consistency of about 0.1 percent. Pulp fibers from each machine chest were sent through separate manifolds in the headbox to create a 3-layered tissue structure. The flow rates of the stock pulp fiber slurries into the flow spreader were adjusted to give a target web basis. In those instances where a layer structure was produced, flow of stock pulp fiber slurries was controlled to provide a layer split of about 30 to about 35 percent by total weight of the tissue web EHWK on both outer layers and 30 to about 40 percent NSWK in the center layer. In those instances where macroalgae was introduced to the layered sheet it was introduced to a single layer, displacing the fiber otherwise associated with that layer. The fibers were deposited onto a felt using a Crescent Former.

The wet sheet, about 10 to 20 percent consistency, was adhered to a Yankee dryer, traveling at about 80 to 120 fpm through a nip via a pressure roll. The consistency of the wet sheet after the pressure roll nip (post-pressure roll consistency or PPRC) was approximately 40 percent. A spray boom situated underneath the Yankee dryer sprayed a creping composition at a pressure of 60 psi at a rate of approximately 0.25 g solids/m$^2$ of product. The creping composition comprised 0.16 percent by weight of polyvinyl alcohol (PVOH), (Celvol™ 523 available from Celanese Chemicals, Calvert City, Ky.), 0.013 percent by weight PAE resin (Kymene™ 6500 available from Ashland, Covington, Ky.) and 0.0013 percent by weight of Resozol™ 2008 (Ashland, Covington, Ky.).

The sheet was dried to about 98 to 99 percent consistency as it traveled on the Yankee dryer and to the creping blade. The creping blade subsequently scraped the tissue sheet and a portion of the creping composition off the Yankee dryer. The creped tissue basesheet was then wound onto a core traveling at about 50 to about 100 fpm into soft rolls for converting.

Samples produced according to the present example are summarized in Tables 4 and 5 below.

TABLE 4

| Sample | Bone Dry Basis Wt. (gsm) | Web Structure | Macroalgae Layer | Red Algae Total Web (wt %) | EHWK Total Web (wt %) | NSWK Total Web (wt %) |
|---|---|---|---|---|---|---|
| Control 1 | 15.7 | 3 Layer | NA | 0 | 65 | 35 |
| 1 | 15.3 | 3 Layer | Outer Layers | 6.5 | 59.5 | 35 |

TABLE 5

| Sample | GMT Index | MD Tensile Index | MD Stretch (%) | GMT (g/3") | GMM (kg) |
|---|---|---|---|---|---|
| Control 1 | 52.74 | 65.5 | 25.9 | 828 | 7.41 |
| 1 | 89.28 | 121.76 | 25.1 | 1366 | 11.06 |

Example 2

Conventional Wet Pressed Tissue Comprising Macroalgae Wet Lap Pulp

Additional samples were made as described above using a wet pressed process utilizing a Crescent Former with the exception that macroalgae was incorporated to the tissue web as a wet lap pulp. Where used, wet lap red algae pulp was added to the dump chest containing dispersed EHWK or NSWK. Additional EHWK or NSWK was added as necessary to adjust for the desired concentration of algae in the mix. Algae fiber was added over a period of 5 minutes so as to avoid clumping. Once pumped to the machine chest and diluted further, stock containing macroalgae fiber was allowed to disperse for 5 minutes more in the machine chest prior to the stock solution being sent to the headbox. The resulting layered tissue webs are summarized in Table 6 below.

TABLE 6

| Sample | Bone Dry Basis Wt. (gsm) | Web Structure | Macroalgae Layer | Red Algae Total Web (wt %) | EHWK Total Web (wt %) | NSWK Total Web (wt %) |
|---|---|---|---|---|---|---|
| Control 1 | 15.7 | 3 Layer | NA | 0 | 70 | 30 |
| 1 | 16.0 | 3 Layer | 1st Outer Layer | 1.8 | 68.2 | 30 |
| 2 | 15.3 | 3 Layer | Inner Layer | 1.8 | 70 | 28.2 |

In other instances a blended web was produced by weighing out the appropriate amount of each fiber type and adding them to the pulper to be dispersed for 30 minutes at 3 percent consistency at about 100° F. The pulp slurry was then transferred to the dump chest and subsequently diluted to approximately 0.75 percent consistency. The slurry was then pumped to the machine chest and further diluted to approximately 0.1 percent consistency before being pumped to a 3-layer headbox such that all 3-layer splits were evenly distributed. The resulting blended tissue webs are summarized in Table 7 below.

TABLE 7

| Sample | Bone Dry Basis Wt. (gsm) | Web Structure | Macroalgae Layer | Red Algae Total Web (wt %) | EHWK Total Web (wt %) | NSWK Total Web (wt %) |
|---|---|---|---|---|---|---|
| Control 2 | 20.0 | Blended | NA | 0 | 70 | 30 |
| 3 | 18.1 | Blended | NA | 1 | 69.3 | 29.7 |
| 4 | 18.7 | Blended | NA | 2 | 68.6 | 29.4 |
| 5 | 16.8 | Blended | NA | 4 | 67.2 | 28.8 |

The physical properties of the resulting layered and blended webs are summarized in Table 8 below.

TABLE 8

| Sample | GMT Index | MD Tensile Index | MD Stretch (%) | GMT (g/3") | GMM (kg) | GM Tear |
|---|---|---|---|---|---|---|
| Control 1 | 26.57 | 36.4 | 24.6 | 417 | 4.75 | 10.7 |
| 1 | 30.25 | 40.94 | 20.7 | 484 | 5.37 | 9.3 |
| 2 | 37.32 | 46.28 | 25.5 | 571 | 5.16 | 9.9 |
| Control 2 | 37.95 | 48.9 | 22.2 | 759 | 8.7 | 6.8 |
| 3 | 38.4 | 48.84 | 24.8 | 695 | 7.4 | 6.3 |
| 4 | 44.17 | 59.89 | 24.3 | 826 | 7.9 | 6.8 |
| 5 | 52.32 | 67.02 | 24.9 | 879 | 9.6 | 7.2 |

The relative change in the MD Tensile Index, MD Durability Index and Stiffness Index, compared to an identical control without macroalgae, is summarized in Table 9 below.

TABLE 9

| Sample | Red Algae Total Web (wt %) | Red Algae Layer | Stiffness Index | MD Durability Index | Delta Durability Index (%) | Delta Stiffness Index (%) |
|---|---|---|---|---|---|---|
| 1 | 1.8 | Outer | 11.10 | 12.84 | 3.3% | −2.6% |
| 2 | 1.8 | Inner | 9.04 | 14.17 | 14.1% | −20.7% |
| 3 | 1 | — | 10.65 | 14.53 | 1.6% | −7.1% |
| 4 | 2 | — | 9.56 | 16.22 | 13.4% | −16.6% |
| 5 | 4 | — | 10.92 | 17.35 | 21.4% | −4.7% |

Example 3

Uncreped Through-Air Dried Tissue Comprising Macroalgae Dry Lap Pulp

A single ply through-air dried tissue web was made generally in accordance with U.S. Pat. No. 5,607,551, which is herein incorporated by reference in a manner consistent with the present disclosure. Initially NSWK was dispersed in a pulper for 30 minutes at 3 percent consistency at about 100° F. The NSWK was then transferred to a dump chest and subsequently diluted to approximately 0.75 percent consistency. EHWK was dispersed in a pulper for 30 minutes at about 3 percent consistency at about 100° F. The EHWK was then transferred to a dump chest and subsequently diluted to about 0.75 percent consistency. Two separate dispersions of red algae (RA) dry lap pulp were prepared depending upon which layer of the tissue web the red algae was to be added to. Dry lap red algae pulps (80% EHWK/20% red algae or 80% SSWK/20% red algae, by weight) prepared as described above, were dispersed in a pulper for 30 minutes at about 3 percent consistency at about 100° F. and then transferred to a dump chest and subsequently diluted to about 0.75 percent consistency.

The pulp slurries were subsequently pumped to separate machine chests and further diluted to a consistency of about 0.1 percent. Pulp fibers from each machine chest were sent through separate manifolds in the headbox to create a 3-layered tissue structure. The flow rates of the stock pulp fiber slurries into the flow spreader were adjusted to give a target web basis. The fiber compositions of the layered sheets are described in Table 10 below. The formed web was non-compressively dewatered and rush transferred to a transfer fabric traveling at a speed about 25 percent slower than the forming fabric. The web was then transferred to a throughdrying fabric and dried.

The relative change in the MD Tensile Index, MD Durability Index and Stiffness Index, compared to an identical control without macroalgae, is summarized in Table 12 below.

TABLE 12

| Sample | Control | RA Total Web (wt %) | RA Layer | Delta MD Tensile Index (%) | Delta Durability Index (%) | Delta Stiffness Index (%) |
|---|---|---|---|---|---|---|
| 6 | Control 3 | 3 | Outer | 23.1% | 14.0% | −6.5% |
| 7 | Control 3 | 6 | Outer | 45.5% | 27.0% | −15.3% |
| 10 | Control 4 | 4 | Inner | 37.2% | 19.6% | −9.5% |
| 11 | Control 5 | 3 | Inner | 59.9% | 30.0% | −11.3% |
| 12 | Control 6 | 2 | Inner | 36.8% | 18.6% | −11.6% |
| 13 | Control 7 | 6 | Inner | 103.5% | 51.4% | −11.9% |

Example 4

Tissue Core Wrap

Additional tissue webs having a basis weight of about 20 or about 30 gsm were prepared for use as core wrap in an absorbent article. Core wrap samples were made using a conventional wet press or UCTAD process, as described above. In each instance the core wrap was formed as a blended web comprising EHWK and macroalgae. The specific core wrap samples are summarized in Table 13 below.

TABLE 10

| Sample | Outer layers (1) (wt % of layer) | Inner Layer (2) (wt % of layer) | Wt. Inner Layer:Wt. Outer Layers | Refining (layer) minutes | Basis Wt. (gsm) | EHWK Total Web (wt %) | RA Total Web (wt %) | NSWK Total Web (wt %) | SSWK Total Web (wt %) |
|---|---|---|---|---|---|---|---|---|---|
| Control 3 (1b) | EHWK | NBSK | 60:40 | (2)2.5 | 35.2 | 60 | 0 | 40 | 0 |
| 6 (2a) | 5% RA/EHWK | NBSK | 60:40 | (2)2.5 | 36.1 | 57 | 3 | 40 | 0 |
| 7 (3a) | 10% RA/EHWK | NBSK | 60:40 | (2)2.5 | 35.7 | 54 | 6 | 40 | 0 |
| 8 (4a) | EHWK | 20% RA/EHWK | 60:40 | — | 35.2 | 92 | 8 | 0 | 0 |
| 9 (5a) | 20% RA/EHWK | EHWK | 60:40 | — | 28.7 | 92 | 8 | 0 | 0 |
| 10 (6a) | EHWK | 10% RA/SSWK | 60:40 | — | 36.0 | 60 | 4 | 0 | 36 |
| 11 (6b) | EHWK | 10% RA/SSWK | 70:30 | — | 34.7 | 70 | 3 | 0 | 27 |
| 12 (6c) | EHWK | 10% RA/SSWK | 80:20 | — | 34.9 | 80 | 2 | 0 | 18 |
| 13 (6d) | EHWK | 10% RA/SSWK | 40:60 | — | 35.3 | 40 | 6 | 0 | 54 |
| Control 4 (8a) | EHWK | SSWK | 60:40 | — | 35.6 | 60 | 0 | 0 | 40 |
| Control 5 (8b) | EHWK | SSWK | 70:30 | — | 35.9 | 70 | 0 | 0 | 30 |
| Control 6 (8c) | EHWK | SSWK | 80:20 | — | 35.4 | 80 | 0 | 0 | 20 |
| Control 7 (8d) | EHWK | SSWK | 40:60 | — | 34.3 | 40 | 0 | 0 | 60 |

TABLE 11

| Sample | Bulk ($cm^3/g$) | GMT (g/3") | GMM (kg) | MDT (g/3") | MDS (%) | Stiffness Index | MD Durability Index | Dry Burst (gf) | GM Tear | MFP (microns) | % Pores >50 microns |
|---|---|---|---|---|---|---|---|---|---|---|---|
| Control 3 | 16.0 | 1530 | 12.3 | 2075 | 22.5 | 8.04 | 15.91 | 833 | 16.5 | — | — |
| 6 | 15.8 | 2062 | 15.5 | 2620 | 24.5 | 7.52 | 18.13 | 1173 | 22.3 | 23.92 | 0.2 |
| 7 | 16.1 | 2246 | 15.3 | 3061 | 26.7 | 6.81 | 20.20 | 1351 | 25.4 | 21.32 | 0.09 |
| 8 | 16.0 | 1453 | 10.7 | 1610 | 17.5 | 7.36 | 13.31 | 804 | 10.7 | 16.5 | 0 |
| 9 | 18.5 | 935 | 8.8 | 1049 | 16.5 | 9.41 | 11.65 | 501 | 6.8 | 22.81 | 0.16 |
| 10 | 15.4 | 1237 | 10.7 | 1496 | 20.4 | 8.65 | 12.91 | — | 16.7 | 26.15 | 0 |
| 11 | 15.7 | 1109 | 9.7 | 1394 | 20.0 | 8.75 | 12.64 | — | 11.3 | 25.53 | 0 |
| 12 | 15.6 | 953 | 8.6 | 1115 | 18.2 | 9.02 | 11.02 | — | 9.6 | 24.41 | 0 |
| 13 | 15.7 | 1457 | 11.9 | 2101 | 22.7 | 8.17 | 16.01 | — | 18.6 | 27.63 | 0.49 |
| Control 4 | 15.3 | 785 | 7.5 | 1078 | 19.0 | 9.55 | 10.80 | — | 9.8 | 29.37 | 1.17 |
| Control 5 | 15.1 | 710 | 7.0 | 902 | 17.9 | 9.86 | 9.72 | — | 8.3 | 27.01 | 0.21 |
| Control 6 | 14.9 | 686 | 7.0 | 827 | 17.1 | 10.20 | 9.29 | — | 7.1 | 25.28 | 0.01 |
| Control 7 | 15.7 | 723 | 6.7 | 1003 | 18.7 | 9.27 | 10.57 | — | 9.6 | 33.94 | 3.7 |

TABLE 13

| Sample | Process | Fiber Blend RA/EWHK (wt %) | Basis Weight (gsm) | Dry Burst (gf) | GMT (g/3") | Dry MD Tensile (g/3") | Wet MD Tensile (g/3") | Wet:Dry MD Tensile |
|---|---|---|---|---|---|---|---|---|
| 14 | CWP | 20/80 | 20 | 92.6 | 1037 | 1235 | 355 | 0.29 |
| 14 | CWP | 20/80 | 30 | 137.2 | 1531 | 1913 | 522 | 0.27 |
| 15 | CWP | 10/90 | 20 | 106.9 | 879 | 1047 | 390 | 0.37 |
| 16 | CWP | 10/90 | 30 | 162.5 | 1442 | 1768 | 733 | 0.41 |
| 17 | UCTAD | 20/80 | 20 | 162.9 | 777 | 959 | 329 | 0.34 |
| 18 | UCTAD | 20/80 | 30 | 286.4 | 1463 | 1747 | 655 | 0.37 |
| 19 | UCTAD | 10/90 | 20 | 139.3 | 696 | 846 | 304 | 0.36 |
| 20 | UCTAD | 10/90 | 30 | 222.6 | 1202 | 1143 | 577 | 0.39 |

The physical properties of the resulting blended webs are summarized in Table 14 below. For reference, the physical properties of a commercially available 16.6 gsm tissue core wrap comprising 100% softwood fibers (White Wrap Sheet, available from Cellu Tissue Holdings, Inc., East Hartford, Conn.) are also provided.

TABLE 14

| Sample | Process | Wicking Capacity (g/g) | Retention Capacity (g/g) | MFP (microns) | % Pores >50 microns | SAM Shake (mg) |
|---|---|---|---|---|---|---|
| 14 | CWP | 2.64 | 5.07 | 9.75 | 0 | 0.4 |
| 14 | CWP | 3.13 | 5.25 | 7.15 | 0 | 0.2 |
| 15 | CWP | 3.17 | 4.36 | 14.42 | 0 | 0.2 |
| 16 | CWP | 2.63 | 3.73 | 9.97 | 0 | 0.2 |
| 17 | UCTAD | 4.58 | 9.56 | 20.21 | 1.42 | 4.4 |
| 18 | UCTAD | 4.28 | 6.39 | 15.98 | 0 | 3.4 |
| 19 | UCTAD | 4.61 | 7.87 | 23.92 | 2.23 | 4.4 |
| 20 | UCTAD | 4.35 | 6.39 | 19.03 | 0.2 | 3.4 |
| Cellu Tissue White Wrap Sheet | CWP | 0 | 6.26 | 77.14 | 73 | 0.19 |

While tissue webs and products comprising the same have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

We claim:

1. A method of forming a macroalgae tissue web comprising the steps of:

a. dispersing a macroalgae dry lap pulp to form a first fiber slurry;

b. dispersing a conventional papermaking pulp to form a second fiber slurry;

c. depositing the first and second fiber slurries onto a forming fabric to form a wet web;

d. dewatering the wet web to a consistency of from about 20 to about 30 percent; and e. drying the wet web to a consistency of greater than about 90 percent thereby forming a dried macroalgae tissue web, wherein the dried macroalgae tissue web comprises from about 1 to about 4 percent macroalgae fibers.

2. The method of claim 1 wherein the macroalgae dry lap pulp has a moisture content of less than about 10 percent and wherein the macroalgae dry lap pulp comprises from about 1 to about 30 percent, by weight of the dry lap pulp, macroalgae pulp fibers and from about 99 to about 70 percent, by weight of the dry lap pulp, conventional papermaking fibers.

3. The method of claim 1 further comprising the steps of transferring the dewatered web from the forming fabric to a transfer fabric traveling at a speed from about 10 to about 40 percent slower than the forming fabric; and transferring the web to a throughdrying fabric.

4. The method of claim 1 wherein the drying step comprises transferring the dewatered web to the surface of a Yankee dryer and further comprising the step of creping the dried macroalgae tissue web from the surface of the Yankee dryer.

5. The method of claim 3 further comprising the steps of transferring the web to the surface of a Yankee dryer and creping the web from the surface of the Yankee dryer.

6. The method of claim 1 wherein the dried macroalgae tissue web has a basis weight less than about 60 grams per square meter (gsm) and a sheet bulk greater than about 5 $cm^3/g$.

7. A method of forming a macroalgae tissue web comprising the steps of:

a. forming a macroalgae pulp by mixing never-dried macroalgae pulp fibers and once dried conventional papermaking pulp fibers;

b. dispersing the macroalgae pulp to form a first fiber slurry;

c. dispersing a conventional papermaking pulp to form a second fiber slurry;

d. depositing the first and second fiber slurries onto a forming fabric to form a wet web;

e. dewatering the wet web to a consistency of from about 20 to about 30 percent; and f. drying the wet web to a consistency of greater than about 90 percent thereby forming a dried macroalgae tissue web, wherein the dried macroalgae tissue web comprises from about 1 to about 4 percent macroalgae fibers.

8. The method of claim 7 wherein the macroalgae pulp has a moisture content of less than about 10 percent and wherein the macroalgae pulp comprises from about 1 to about 30 percent, by weight of the pulp, macroalgae pulp fibers and from about 99 to about 70 percent, by weight of the dry lap pulp, conventional papermaking fibers.

9. The method of claim 7 further comprising the steps of transferring the dewatered web from the forming fabric to a transfer fabric traveling at a speed from about 10 to about 40 percent slower than the forming fabric; and transferring the web to a throughdrying fabric.

10. The method of claim 7 wherein the drying step comprises transferring the dewatered web to the surface of a Yankee dryer and further comprising the step of creping the dried macroalgae tissue web from the surface of the Yankee dryer.

11. The method of claim 9 further comprising the steps of transferring the web to the surface of a Yankee dryer and creping the web from the surface of the Yankee dryer.

12. A method of forming a multi-layered macroalgae tissue web comprising the steps of:

a. dispersing a macroalgae dry lap pulp to form a first fiber slurry;
b. dispersing a conventional papermaking pulp to form a second fiber slurry;
c. forming a multi-layered wet web by depositing the first fiber slurry on top of the second fiber slurry onto a forming fabric;
d. dewatering the multi-layered wet web to a consistency of from about 20 to about 30 percent; and
e. drying the multi-layered wet web to a consistency of greater than about 90 percent thereby forming a dried multi-layered macroalgae tissue web, wherein the first layer comprises conventional papermaking fibers and the second layer comprises from about 1 to about 4 percent, by weight of the total tissue web, macroalgae fibers, the tissue web having a basis weight less than about 60 grams per square meter (gsm) and a sheet bulk greater than about 5 $cm^3/g$.

13. The method of claim 12 further comprising the step of depositing the second fiber slurry on top of the first fiber slurry thereby forming a three layered wet web.

14. The method of claim 12 wherein the first layer is substantially free from macroalgae fibers.

15. The method of claim 12 wherein the macroalgae dry lap pulp has a moisture content of less than about 10 percent and wherein the macroalgae dry lap pulp comprises from about 1 to about 30 percent, by weight of the dry lap pulp, macroalgae pulp fibers and from about 99 to about 70 percent, by weight of the dry lap pulp, conventional papermaking fibers.

16. The method of claim 12 further comprising the steps of transferring the dewatered web from the forming fabric to a transfer fabric traveling at a speed from about 10 to about 40 percent slower than the forming fabric; and transferring the web to a throughdrying fabric.

17. The method of claim 12 wherein the drying step comprises transferring the dewatered web to the surface of a Yankee dryer and further comprising the step of creping the dried macroalgae tissue web from the surface of the Yankee dryer.

18. The method of claim 17 further comprising the steps of transferring the web to the surface of a Yankee dryer and creping the web from the surface of the Yankee dryer.

19. The method of claim 12 wherein the dried macroalgae tissue web comprises from about 1 to about 4 weight percent macroalgae fibers, the tissue web having has a basis weight less than about 60 grams per square meter (gsm) and a sheet bulk greater than about 5 $cm^3/g$.

* * * * *